United States Patent [19]

Millard et al.

[11] 4,028,281

[45] June 7, 1977

[54] METAL PLATE TREATING SOLUTION

[75] Inventors: Ben Millard, South Windham; Susan P. Robie, Gorham, both of Maine

[73] Assignee: Scott Paper Company, Philadelphia, Pa.

[22] Filed: Dec. 8, 1975

[21] Appl. No.: 638,926

[52] U.S. Cl. ..... 252/527; 101/451; 101/465; 106/14.5; 134/40; 252/140; 252/173; 252/DIG. 11; 252/DIG. 14; 427/144; 427/435

[51] Int. Cl.[2] ..... B41N 3/06; C11D 3/08; C11D 3/33; C23G 5/02

[58] Field of Search ..... 134/40, 42; 101/451, 101/465; 252/82, 85, 180, 527, 546, DIG. 11, 173, DIG. 14; 106/14.5; 427/144, 435

[56] References Cited

UNITED STATES PATENTS

| | | | |
|---|---|---|---|
| 3,001,945 | 9/1961 | Drew | 252/547 X |
| 3,394,653 | 7/1968 | Riesberg | 101/465 |
| 3,672,885 | 6/1972 | Ort | 101/465 X |
| 3,951,840 | 4/1976 | Fujino | 252/102 |

*Primary Examiner*—Dennis L. Albrecht
*Attorney, Agent, or Firm*—Nicholas J. DeBenedictis; John W. Kane, Jr.

[57] ABSTRACT

A solution for treating metal surfaces is provided which is capable of cleaning (degreasing) and hydrophilically sensitizing the metal surface. The treatment solution is a synergistic improvement over conventional silicate treating solutions obtained by the addition of the ferric chelate of ethylene diamine tetra acetic acid ($Fe^{+3}$EDTA).

5 Claims, No Drawings

METAL PLATE TREATING SOLUTION

BACKGROUND OF THE INVENTION

Field of the Invention

This invention concerns treating solutions for metal printing plates particularly aluminum printing plates to degrease the plates and hydrophilically sensitize the surface.

Metal planographic plates are commercially available items used in the printing and copying industry. Before a metal plate can function as a planographic printing plate it is necessary for the metal surface to be hydrophilically sensitized, that is, for the surface to have a water-wettable coating which can receive an ink-receptive, water-repellant image.

One method of hydrophilically sensitizing a metal surface, particularly an aluminum surface, is by treating the surface with an aqueous alkali metal silicate solution such as a sodium or potassium meta-silicate solution. Such solutions have also been used to clean smudges, and to remove scratches and faint imperfections such as surface scratches from imaged and developed paper printing plates. Other alkaline salts of a stron base and a weak acid in addition to alkali metal silicates have been used in such solutions. See U.S. Pat. No. 3,394,653 entitled NOVEL METHOD OF CLEANING PAPER PLANOGRAPHIC PLATES issued July 30, 1968 to Robert E. Riesberg.

U.S. Pat. No. 3,672,885 issued June 27, 1972 to George M. Ort employed a chelating agent for $Fe^{+2}$ or $Fe^{+3}$ ions to improve the stability of ferrocyanide against oxidative precipitation. The present invention does not employ ferrocyanide and accordingly does not form stable ferrocyanide containing complexes.

SUMMARY OF THE INVENTION

An improved surface treating solution capable of degreasing the surface of metals such as aluminum, and making the surface hydrophilic is provided. The metal surface treating solution comprises an aqueous solution containing a wetting agent, an alkali metal silicate, a ferric chelate of ethylene diamine tetra acetic acid ($Fe^{+3}$ EDTA) and preferably an ink solvent such as n-propoxy propanol. Such a treatment solution can also be used as a cleaning and scratch removing solution or imaged and developed planographic printing plates.

DETAILED DESCRIPTION OF THE INVENTION AND THE PREFERRED EMBODIMENTS

The novelty of the present invention resides primarily in the ferric chelate of ethylene diamine tetra acetic acid ($Fe^{+3}$ EDTA) which enhances the functionality of the alkali metal silicate treatment solution particularly the tenacity of the hydrophilic silicate coating on the metal surface. The $Fe^{+3}$ EDTA chelate should be present in the aqueous treatment solution in an amount of from about 1.0 parts to about 5.0 parts per 100 parts of treatment solution with about 2.0 parts by eight being particularly preferred.

In addition to the ferric chelate of EDTA, a wetting agent is preferably included in the treatment solution in an amount of from about 0.05 parts to about 5.0 parts with about 1.0 parts by weight per 100 parts being particularly preferred. A number of known water active surfactants (wetting agents) can be added to the aqueous treatment solution to improve the cleaning ability thereof and also to improve the image of the plate. Example of suitable wetting agents are alkali metal salts of alklaryl sulfonates such as sodium dodecyl benzene sulfonate, alkali metal salts of alkyl sulfonates having 12 to 20 carbons atoms; alkali metal salts of sulfated fatty alcohols having 10 to 20 carbon atoms such as sodium tetradecyl sulfates; sulfated oils such as turkey-red oil, and non-ionic surfactants such as isooctylphenyl polyethoxyethanol. Particularly preferred is sodium dodecyl benzene sulfonate.

The alkali metal silicate component of the treatment solution produces a silicate coating on the metal surface which hydrophilically sensitizes the metal surface of the plate such as an aluminum plate. A particularly preferred alkali metal silicate is sodium-meta-silicate. The alkali metal silicate should be present in the treatment solution in an amount of from about 0.5 parts by weight to about 10.0 parts by weight with about 2.5 to about 4 parts by weight being particularly preferred.

An ink-solvent can also be incorporated into the cleaning and treating solution of the present invention. A preferred solvent is n-propoxy propanol. The solvent should be present in an amount of from about 1.0 parts to about 10.0 parts by weight with about 2.5 parts by weight being particularly preferred. n-propanol is another example of a suitable ink solvent.

The following examples are intended to demonstrate the functionality of the present invention without limiting the scope thereof. All parts stated herein are by weight unless indicated otherwise.

EXAMPLE 1

A non-degreased aluminum plate (Alcoa 3003 aluminum alloy) was treated with a solution of the present invention comprising:

| Component | Parts |
|---|---|
| Sodium Dodecyl Benzene Sulfonate | 0.4 |
| Sodium-meta-Silicate | 1.07 |
| VERSENE $Fe^{+3}$EDTA) | 0.8 |
| n-propoxy propanol | 1.0 |
| Water | 37.0 |

A second sheet of non-degreased aluminum alloy was treated with a conventional 4 % silicate solution. After treatment, the surfaces of both aluminum plates were rubbed with ink and rinsed with water. The surface treated with the solution of the invention rinsed cleanly while the surface of the control plate had streaks and patches of residual ink. This test indicates that the hydrophilic silicate coating deposited on the aluminum alloy by the solution of the present invention was held more tenaciously to the aluminum and accordingly the surface remained hydrophilically sensitized (ink-repellent) while portions of the metal treated with the conventional silicate solution had streaks and patches of ink where the ink repellent characteristics of the surface were removed.

EXAMPLE 2

A treatment solution of the present invention was used as a plate cleaning and scratch remover solution for brushed-grained silicated aluminum printing plates sensitized with a diazo coating. The treatment solution contained:

| Component | Parts by Weight |
|---|---|
| EDTA $Fe^{+3}$ | 2.0 |
| Sodium-meta-Silicate | 2.0 |
| Sodium Dodecyl Benzene Sulfonate | 1.0 |
| n-propoxy propanol | 2.5 |
| Water | 90.0 |

A brush-grained silicated aluminum printing plate sensitized with a diazo coating was cleaned with the above formulation. The plate was then mounted on a Harris printing press and tested to 28,000 copies without losing the hydrophilicity imparted to the plate at the time of treatment.

EXAMPLE 3

A treatment solution of the present invention was tested in this example as a cleaning solution and as a scratch remover on a presensitized printing plate comprised of a 5 mil grained aluminum base with a photosensitive diazo coating. The treatment solution of the present invention had the following composition.

| Component | Parts by Weight |
|---|---|
| Sodium Dodecyl Benzene Sulfonate | 0.88 |
| Sodium-meta-Silicate | 2.14 |
| VERSENE $Fe^{+3}$ ($Fe^{+3}$EDTA) | 1.76 |
| n-propoxy propanol | 2.20 |
| Water | 81.50 |

The plate was imaged, developed, mounted on a printing press and used to print 100 copies. The plate was then removed, scratched in three places and then cleaned. One of the scratches was cleaned with the treatment solution of the present invention, the other two scratch areas were cleaned with commercially available cleaner and scratch removers (3M Company Brand 'S'and 'R'scratch remover). The plate was then remounted on the printing press and run to 500 copies. The plate was then removed from the printing press and held for 5 days with the ink on it. When remounted on the press, the plate plugged in the image area. The plate was then cleaned with the treatment solution of the present invention and used to print additional copies. From an inspection of the printed copies made from the plate the following conclusions were drawn; (1) treatment solution of the present invention gave superior performance in comparison to the commerically available treatment solutions ('S' and 'R'), (2) scratches are removed more permanently by the treatment solution of the present invention in comparison to the commerical treatment solutions, (3) dried ink is effectively cleaned from the printing plate by the treatment solution of the present invention.

As can be seen from the above examples, the treatment solution of the present invention effectively cleans printing plates and removes scratches more completely and significantly more permanently than commercially available scratch removing solutions containing silicates. The treatment solution can be used on any metal surface printing plate which includes solid metal printing plates and laminated plates having a metal surface with or without a photosensitive coating. Particularly preferred are aluminum printing plates.

What is claimed is:

1. An aqueous solution capable of cleaning and imparting a hydrophilic silicate coating onto a metal surface, said solution comprising:

from 0.5 parts by weight to 10.0 parts by weight of an alkali metal silicate;

from 0.05 parts to 5.0 parts by weight of a water active surfactant;

from 1.0 parts to 5.0 parts of a ferric chelate of elthylene diamine tetra acetic acid;

and water.

2. The treatment solution of claim 1 further comprising:

from 1.0 parts to 10.0 parts by weight of an ink solvent.

3. The treatment solution of claim 1 wherein the alkali metal silicate is sodium-meta-silicate.

4. The treatment solution of claim 1 wherein the water active surfactant is sodium dodecyl benzene sulfonate.

5. The treatment solution of claim 2 wherein the ink solvent is n-propoxy propanol.

* * * * *